US009306303B2

(12) United States Patent
Chen et al.

(10) Patent No.: US 9,306,303 B2
(45) Date of Patent: Apr. 5, 2016

(54) ELECTRICAL CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Ping-Chuan Chu, New Taipei (TW); Xiao-Juan Qi, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/536,665

(22) Filed: Nov. 9, 2014

(65) Prior Publication Data

US 2015/0229049 A1 Aug. 13, 2015

(30) Foreign Application Priority Data

Feb. 7, 2014 (CN) ..... 2014 1 0044580

(51) Int. Cl.

| | |
|---|---|
| ***H01R 12/79*** | (2011.01) |
| ***H01R 12/75*** | (2011.01) |
| ***H01R 12/70*** | (2011.01) |
| *H01R 13/518* | (2006.01) |
| *H01R 13/639* | (2006.01) |

(52) U.S. Cl.

CPC ..... *H01R 12/75* (2013.01); *H01R 12/707* (2013.01)

(58) Field of Classification Search

CPC ..... H01R 12/79; H01R 12/716; H01R 12/75; H01R 13/6273; H01R 13/6275; H01R 13/639; H01R 13/518

USPC ..... 439/83, 692

See application file for complete search history.

(56) References Cited

U.S. PATENT DOCUMENTS

| | | | | |
|---|---|---|---|---|
| 7,118,424 | B2 * | 10/2006 | Masaki | H01R 12/75 439/682 |
| 7,828,585 | B2 * | 11/2010 | Kurimoto | H01R 13/02 439/357 |
| 8,608,504 | B2 * | 12/2013 | Tseng | H01R 9/034 439/326 |
| 9,048,569 | B2 * | 6/2015 | Chen | H01R 12/716 |
| 2010/0068919 | A1 * | 3/2010 | Taketomi | H01R 12/88 439/499 |
| 2010/0130045 | A1 * | 5/2010 | Higuchi | H01R 12/62 439/260 |
| 2013/0143444 | A1 * | 6/2013 | Chen | H01R 13/518 439/626 |
| 2015/0093928 | A1 * | 4/2015 | Chen | H01R 13/6273 439/352 |
| 2015/0155658 | A1 * | 6/2015 | Urano | H01R 13/639 439/78 |
| 2015/0207244 | A1 * | 7/2015 | Urano | H01R 12/716 439/83 |

* cited by examiner

*Primary Examiner* — Amy Cohen Johnson
*Assistant Examiner* — Matthew T Dzierzynski

(57) ABSTRACT

An electrical connector for a circuit board includes an insulated housing, two narrow metal brackets, and a plurality of conductive contacts. The insulated housing has a connection plate, a raised portion, and two coupling portions at two opposite sides of the raised portion. The raised portion defines a plurality of contact grooves. Each coupling portion is formed in front of the raised portion. The two narrow metal brackets are provided for mounting with the coupling portions of the insulated housing. Each narrow metal bracket has a main plate, front and rear interference tabs for being interfered with one coupling portion of the insulated housing, and at least one positioning tab for being fixed onto the circuit board. The conductive contacts are fitted through the contact grooves of the raised portion.

6 Claims, 6 Drawing Sheets

ELECTRICAL CONNECTOR

FIELD OF THE INVENTION

The present invention relates to a board-end electrical connector to be mounted at a circuit board for connecting with a wire-end connector.

BACKGROUND OF THE INVENTION

Connectors are a component that provides electrical connection between different electronic devices or electronic components, so that electrical current or signal can be transmitted between the devices and thus enables the electronic devices or electronic components to communicate with each other. Since electronic devices or electronic components are usually separated at a certain distance, cables are required for communication therebetween. To facilitate a connection, each cable and its associated circuit board need to facilitate a connection therebetween by a wire-to-board connector. Generally, the wire-to-board connector includes a wire-end connector and a board-end connector. The wire-end connector includes a plurality of wire-end contacts and a wire-end housing that holds the plurality of wire-end contacts. Wires are respectively attached to the plurality of wire-end contacts. The board-end connector is mounted on a circuit board. Although the functions of both connectors are simple, they are usually applied in the circuits of electronic products. Since the space relationship between a cable and a circuit board may be changed with the locations of the associated electronic devices or electronic components, the structural strength of those connectors is important and necessary for ensuring a stable communication therebetween. On the other hand, due to the highly competition of electronic components, the cost is a key point for maintaining the competitiveness of connector components on the market.

The quality, stability, and material saving of a board-end connector will affect the service life, performance, and market acceptance of the associated electronic product. As shown in FIG. 1, an existing board-end connector 6 includes an insulation body 61, a plurality of conductive contacts 62 extended along a longitudinal direction of the insulation body 61, and a metal support 63 for supporting the insulation body 61. To achieve a robust design, the metal support 63 is formed with a large flat plate 632 in addition to the attachment pieces 631 formed at two opposite sides thereof, so that the metal support 63 can provide a full protection for the insulation body 61. Also, with the attachment pieces 631 of the metal support 63, the existing board-end connector 6 can be mounted onto a circuit board (not shown).

With slim and light demand on electronic products, board-end connectors mounted at electronic products need continuous process. In the existing board-end connector 6, since the large flat plate 632 of the metal support 63 has occupied some height of the connector, the insulation body 61 of the connector should be reduced in its thickness to achieve the purpose of reducing the connector's height, thereby causing inadequate structural strength of the insulation body 61. Consequently, the existing board-end connector 6 is liable to be damaged upon an improper force is applied, so that the service life of the connector may be reduced, thus causing troubles to users. Besides, since the molding cavity for the insulation body 61 of the connector is too narrow, bubbles are liable to form in the insulation body 61 during the molding process, thereby reducing the product yield. Also, since the metal support 63 with a large flat plate 632 requires more metal material, the manufacturing cost of the connector will be increased.

In consideration of assembling the elements of the existing board-end connector, since the metal support 63 is assembled to the insulation body 61 and the conductive contacts 62 are assembled to the insulation body 61, as mentioned above, the insulation body 61 should be limited in its thickness for reducing the height of the connector, so that the structural strength of the connector may be poor. Therefore, an improper force may cause damages to the insulation body 61, thereby decreasing the product yield and thus affecting the cost reduction.

For solving the foregoing problems, the applicant has contrived an improved board-end connector, which can save metal material to reduce the manufacturing cost while the insulated housing used in the improved connector can still have an adequate thickness and strength, so as to increase the product yield, enhance the product strength, extend the product's service life, and reduce the damages of the insulated housing, so that the improved connector has a considerable effect over conventional technology.

SUMMARY OF THE INVENTION

One aspect of the present invention is to provide a board-end connector, which has an increased thickness of an insulated housing even under a height limitation thereof, so that the production yield can be increased.

Another aspect of the present invention is to provide a board-end connector, which has an increased strength and a reduced damage rate during the assembling process, so that the assembly yield can be increased.

A further aspect of the present invention is to provide a board-end connector, which can lower the manufacturing cost by reducing the amount of metal material being used in the connector.

A still further aspect of the present invention is to provide a board-end connector, which includes an insulated housing having two coupling portions at its two opposite sides, wherein each coupling portion defines an engaging recess at its front and a positioning recess at its rear respectively for interfering engagement with the front and rear interference tabs of one narrow metal bracket, so that the insulated housing and the narrow metal brackets can be assembled more tightly, so that the structural strength of the board-end connector can be increased.

To achieve the above aspects, the present invention provides a board-end connector for a circuit board, which comprises an insulated housing having a connection plate, a raised portion and two coupling portions at two opposite sides of the raised portion, wherein the raised portion defines a plurality of contact grooves extended along a longitudinal direction thereof, and each coupling portion is formed at its front with an upright support that has an enlarged top end, away from the connection plate; a pair of narrow metal brackets, each corresponding to one of the coupling portions, wherein each of the narrow metal brackets comprises: a main plate connected to outer and bottom sides of the coupling portion corresponding thereto; front and rear interference tabs extended from the main plate and coupled to the coupling portion; and at least one positioning tab disposed at an outer side of the main plate and adapted for engagement with the circuit board; and the conductive contacts, each being fitted through a corresponding one of the contact grooves along the longitudinal direction, wherein each of the conductive contacts has a fixed section disposed within the contact groove corresponding thereto, a solder section extended backwardly from the fixed section for being soldered onto the circuit board, and a connecting section extended forwardly from the fixed section and protruding beyond the connection plate.

The board-end connector disclosed in the present invention allows the insulated housing to have an increased thickness, so that the connector can withstand multiple repeated connections and disconnections. On one hand, each coupling portion of the insulated housing defines an engaging recess and an positioning recess respectively at its front and rear to be respectively engaged with the front and rear interference tabs of one narrow metal bracket, so that the insulated housing and the narrow metal brackets can be assembled more tightly, so that the structural strength of the board-end connector can be increased. On the other hand, the metal material used in the present invention can be reduced, so that the manufacturing cost can be reduced and the product yield can be increased.

Figure 1:
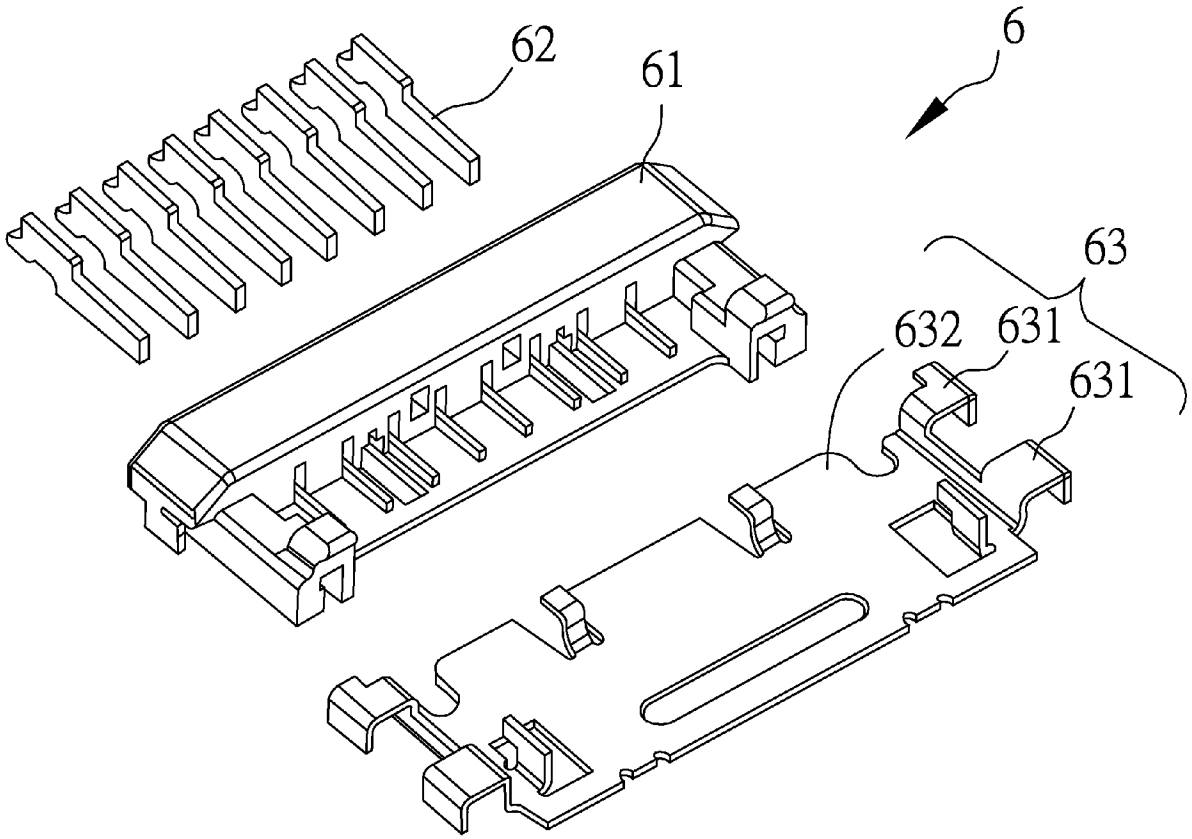
FIG. 1 shows an exploded view of a prior-art connector.

The foregoing and other features and advantages of illustrated embodiment of the present invention will be more readily apparent from the following detailed description, which proceeds with reference to the accompanying drawings.

DETAILED DESCRIPTION OF THE ILLUSTRATED EMBODIMENTS

The following paragraphs will illustrate a preferred embodiment with reference to the accompanying drawings to demonstrate the technical contents, features, and merits of the present invention. In the preferred embodiment, same elements will be indicated by similar reference numerals.

Figure 2:
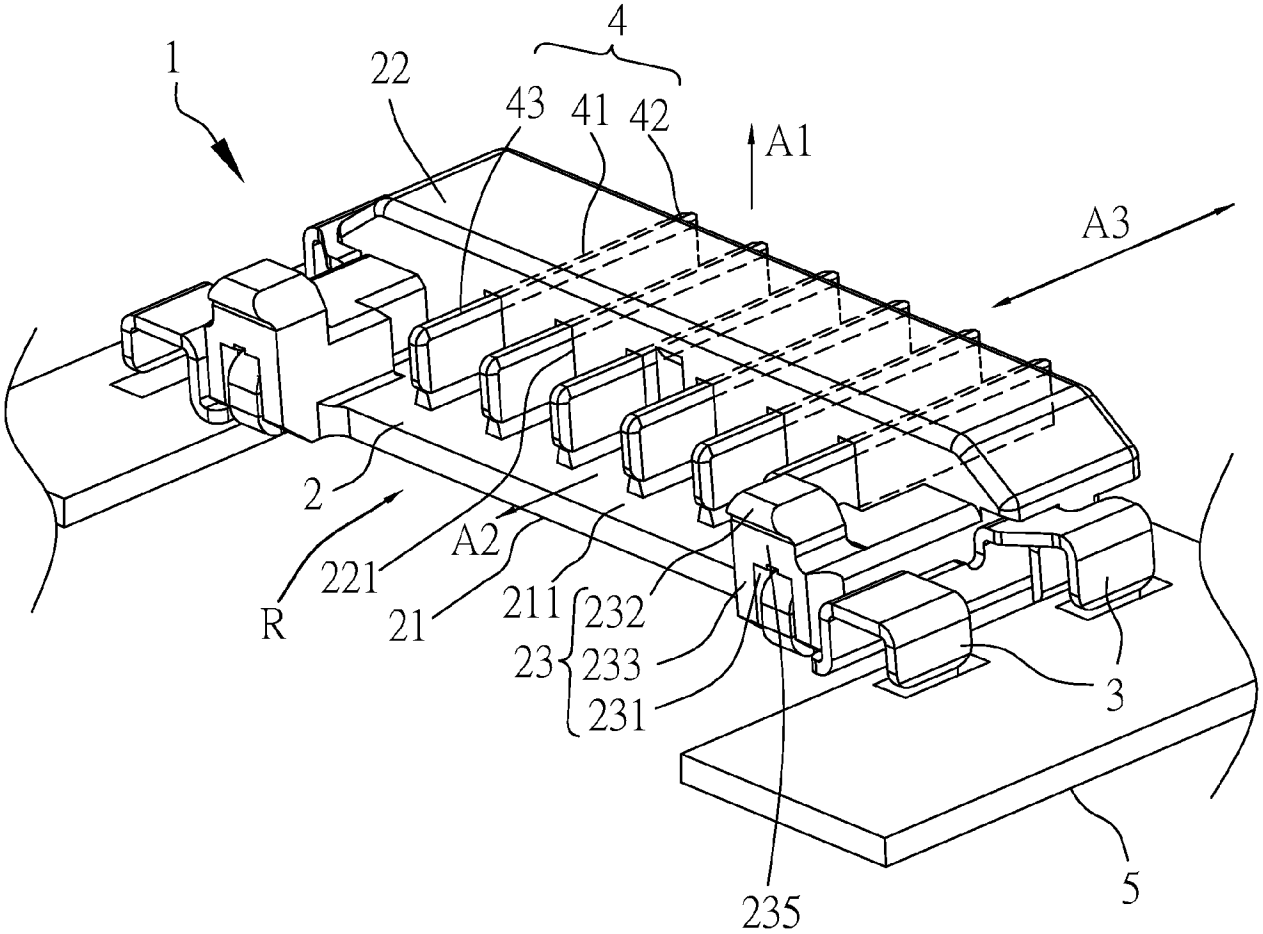
FIG. 2 shows a 3-dimensional view of an electrical connector according to one embodiment of the present invention.
Figure 3:
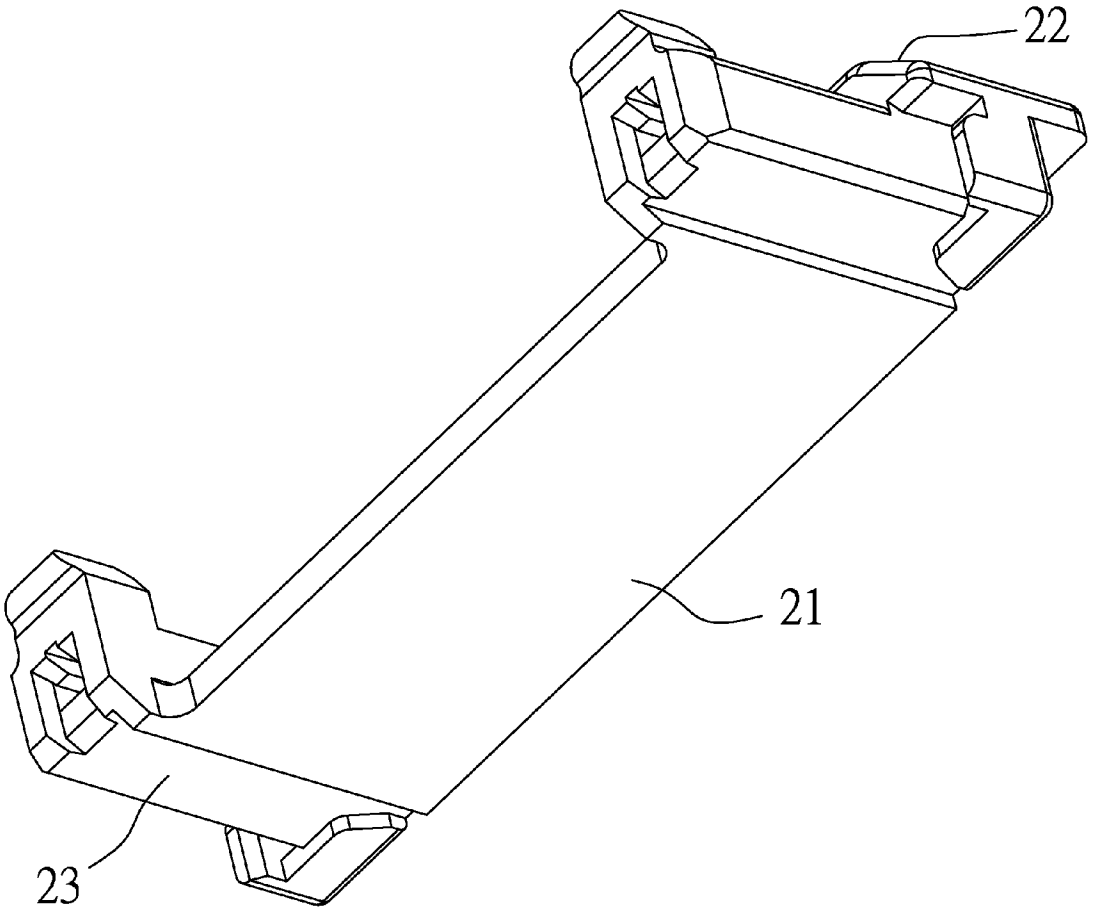
FIG. 3 shows a 3-dimensional view of an insulated housing used in the electrical connector of the embodiment of the present invention.
Figure 4:
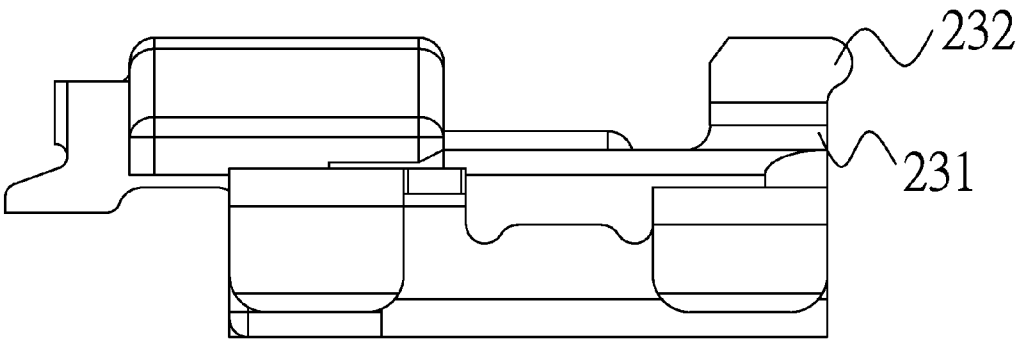
FIG. 4 shows a side view of the electrical connector of the embodiment of the present invention.

Referring to FIGS. 2 through 4, a board-end connector according to the preferred embodiment of the present invention is shown, which generally comprises an insulated housing 2, a pair of narrow metal brackets 3, and a plurality of conductive contacts 4. The insulated housing 2 is made of dielectric material, which is electrically insulated under general household voltage and current. In the embodiment, the insulated housing 2 is injection molded from plastic material having a dielectric characteristic.

The insulated housing 2 includes a connection plate 21, a raised portion 22 and two coupling portions 23. The connection plate 21, the raised portion 22 and two coupling portions 23 together define a recess R. The recess R of the insulated housing 2 is open in a direction A1 perpendicular to and away from the attachment face 211 of the connection plate 21 (i.e., corresponding to a removal direction) and is also open in one out of two opposite directions parallel to the attachment face 211 of the connection plate 21, i.e., in a front direction A2. The raised portion 22 is disposed at one lateral side of the connection plate 21. A plurality of contact grooves 221 are formed through the raised portion 22 and extended along the longitudinal direction A3.

Two coupling portions 23 are extended from the raised portion 22, and positioned at two opposite sides of the connection plate 21. Each of the coupling portions 23 includes an upright support 231, an enlarged top end 232, and an engaging recess 233. The upright support 231 is protruded upwardly from the connection plate 21. The enlarged top end 232 is disposed at the top of the upright support 231. The engaging recess 233 is defined at bottom of the upright support 231, and extended inwardly from the front surface 235 of the upright support 231.

Each of the conductive contacts 4 includes a fixed section 41, a solder section 42 and a connecting section 43. The conductive contacts 4 are secured in the raised portion 22 along a longitudinal direction A3. Each of the fixed sections 41 is inserted in the corresponding contact groove 221.

The solder section 42 is extended backwardly from the fixed section 41 and extended out of the raised portion 22 to be soldered onto a circuit board 5. The connecting section 43 is extended forwardly from the fixed section 41 and protruded out of the raised portion 22. The board-end connector 1 can be electrically connected with the circuit board 5 through the solder section 42, and the board-end connector 1 can be electrically connected to a conductive contact of a wire-end connector (not shown) through the connecting section 43.

More especially, the connecting sections 43 of the conductive contacts 4 will not be subject to a downward force during a connecting operation of the board-end connector 1 and the wire-end connector, so that damages to the connecting sections 43 will not occur. Besides, the enlarged top end 232 allows the board-end connector 1 and a wire-end connector to be fixed together, thus the wire-end connector will not be easy to detach from the board-end connector 1 after a connection is established.

Figure 5:
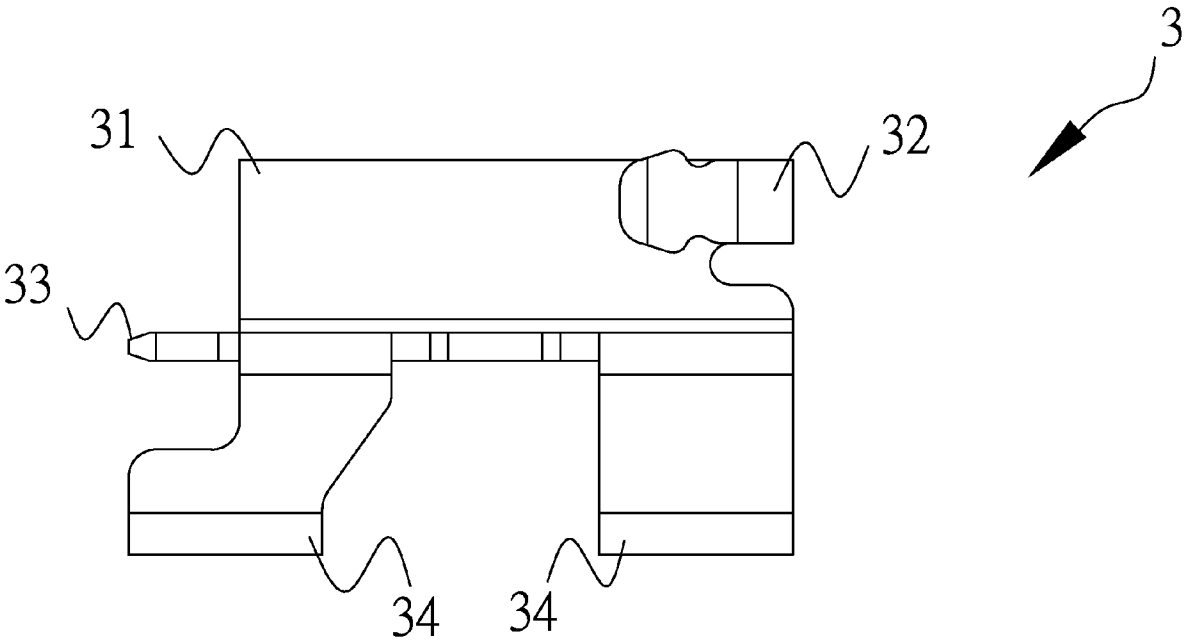
FIG. 5 shows a top view of a narrow metal bracket used in the electrical connector of the embodiment of the present invention.
Figure 6:
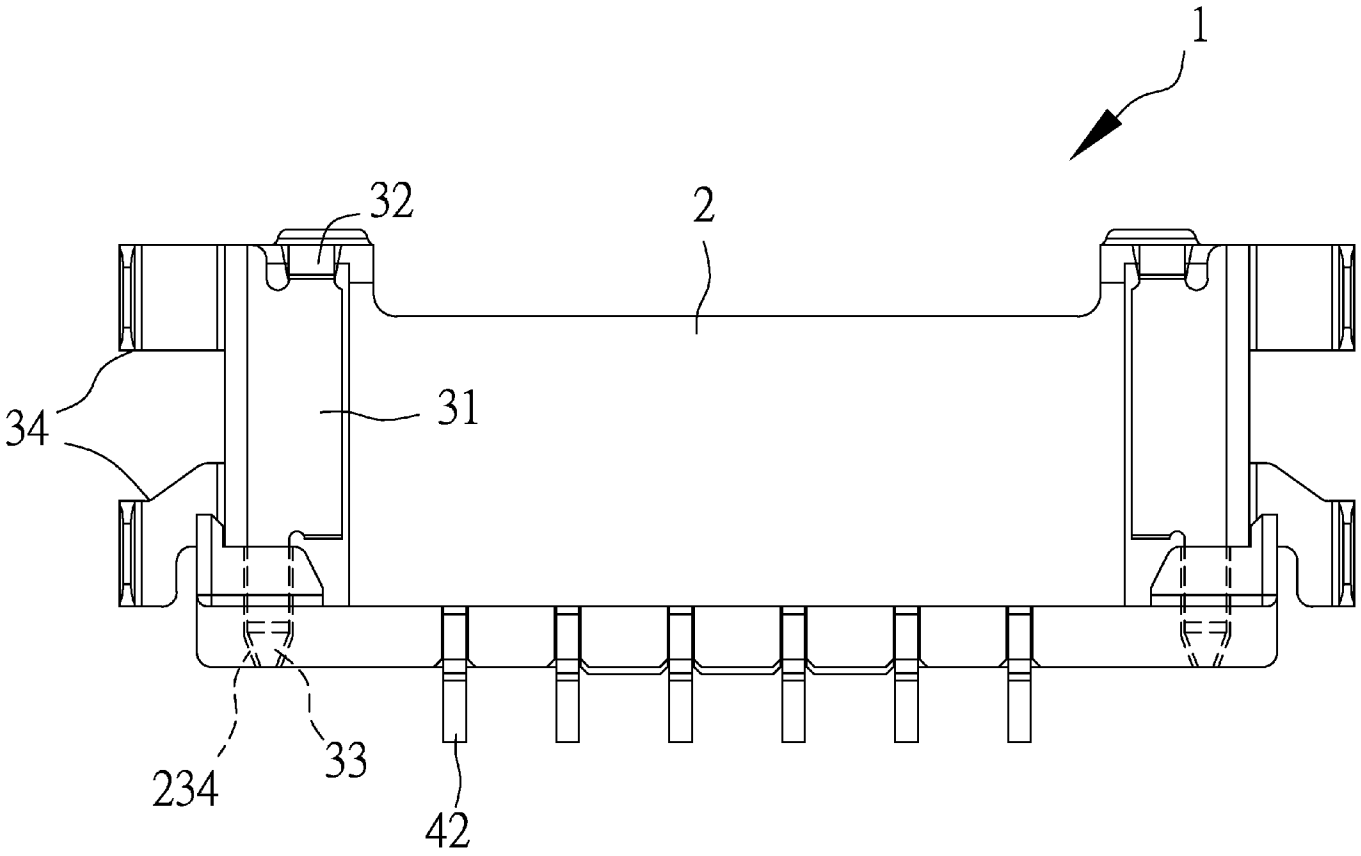
FIG. 6 shows a bottom view of the electrical connector of the embodiment of the present invention.
Figure 7:
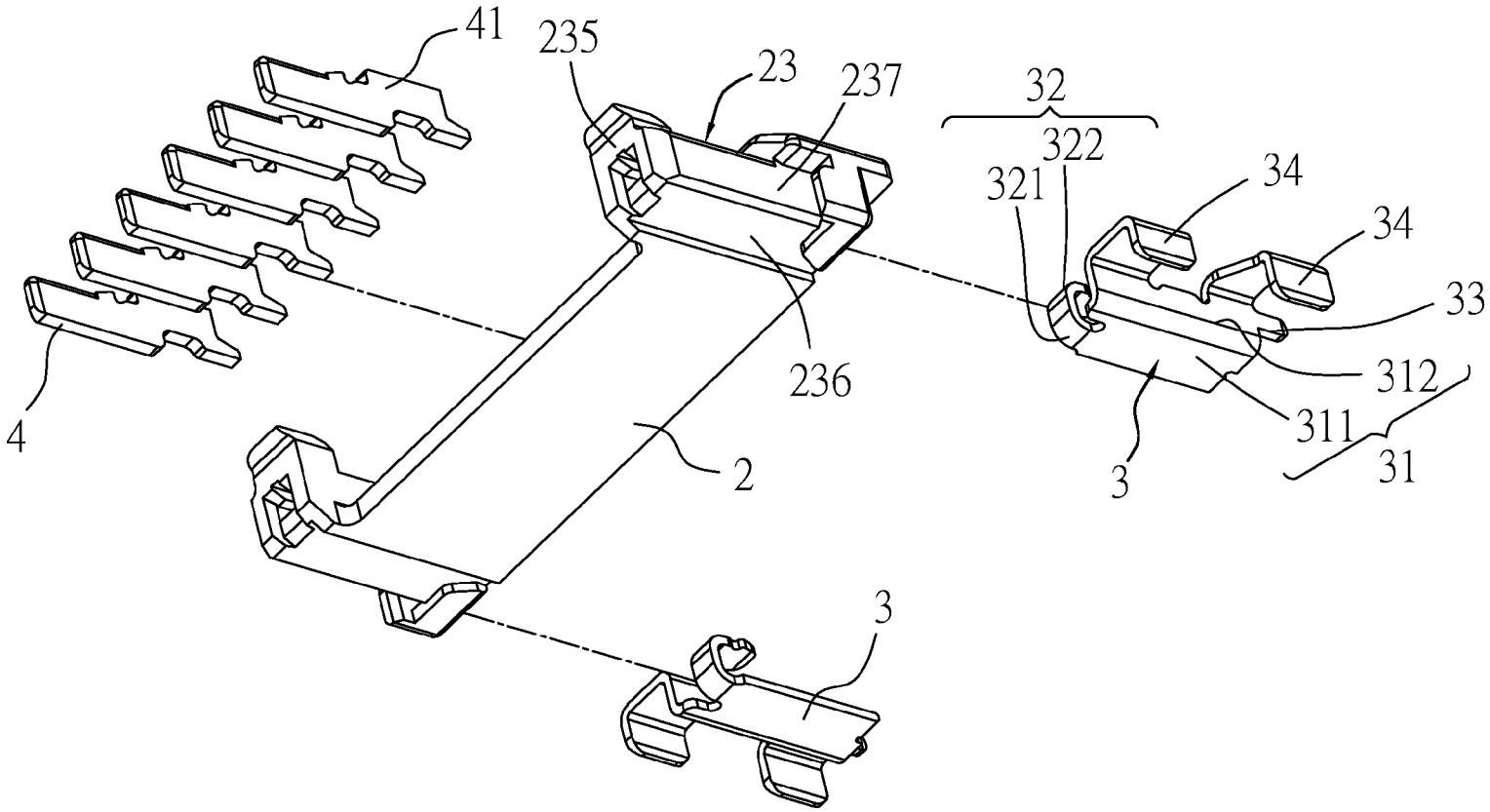
FIG. 7 shows an exploded view of the electrical connector of the embodiment of the present invention.

Referring to FIGS. 5 to 7, the narrow metal brackets 3, which may be formed by bending a metal sheet, are provided for connection to the outer and bottom sides of the coupling portions 23. Each narrow metal bracket 3 has a main plate 31, a front interference tab 32, a rear interference tab 33, and at least one positioning tab 34 at an outer side of the main plate 31. The main plate 31 is substantially L-shaped and includes a bottom plate 311 and a side plate 312 bent from the bottom plate 311. The bottom plate 311 is disposed on the bottom surface 236 of the coupling portion 23, and the side plate 312 is attached to the outer-side surface 237 of the coupling portion 23. The main plate 31 is used to support the entire board-end connector 1 to prevent the connector from damage when an improper force is applied.

The front interference tab 32 includes an extending section 321 and an inserting section 322. The extending section 321 is extending from the bottom plate 311 and bent upwardly, and the inserting section 322 is extended from the extending section 321, bent toward the raised portion 22, and inserted into the engaging recess 233. Two positioning recesses 234 are formed at the coupling portion 23 and extended along the longitudinal direction A3. The rear interference tabs 33 are inserted into the positioning recesses 234, such that the narrow metal brackets 3 can be firmly secured on the insulated housing 2. Therefore, the board-end connector 1 can be strengthened to prevent damages even when the board-end connector 1 and a corresponding wire-end connector have been connected and disconnected for many times. The positioning tab 34 is connected to the side plate 312 and extended outward. The end of the positioning tab 34 is bent downwardly so that the end of the positioning tab 34 is adapted for connecting to the circuit board 5 and serving as a solder pin for the circuit board 5.

Referring to FIG. 7, in assembling the thickened insulated housing 2 and the narrow metal brackets 3, first of all, the rear interference tab 33 of each narrow metal bracket 3 is inserted into the positioning recess 234 of one coupling portions 23 of the insulated housing 2. Next, the front interference tab 32 of each narrow metal bracket 3 is bent upwardly and backwardly to be inserted into the engaging recess 233 of one coupling portion 23 of the insulated housing 2. Next, the main plate 31 of each narrow metal bracket 3 is bent according to the contour of the coupling portion 23 to form an L-shaped configuration to support the insulated housing 2, so that the insulated housing 2 can be prevented from being damaged due to an improper force. Next, the positioning tab 34 of each narrow metal bracket 3 is bent downwardly and soldered onto the circuit board 5. Finally, the conductive contacts 4 are fitted through the multiple contact grooves 221 of the raised portion 22 of the insulated housing 2, and the solder sections 42 of the conductive contacts 4 serve as solder pins, so that the board-end connector 1 is constructed into a sinking-type structure for reducing the mounting space of the board-end connector 1 and meeting the height limitation for an electronic component. The connecting sections 43 of the conductive contacts 4 are adapted for electrical connection to the conductive contacts of a corresponding wire-end connector.

In light of the foregoing, the board-end connector of the present invention, which employs two narrow metal brackets in stead of a large metal support plate used in conventional technology, can reduce the amount of metal material being used in the connector and increase the thickness of the insulated housing, so that the connector can withstand multiple repeated connections and disconnections. Furthermore, each coupling portion of the insulated housing defines an engaging recess and an positioning recess respectively at its front and rear to be respectively engaged with the front and rear interference tabs of one narrow metal bracket, so that the insulated housing and the narrow metal brackets can be assembled more tightly, so that the structural strength of the board-end connector can be increased. Furthermore, in assembling the elements of the present invention, damages of the insulated housing due to an improper force can be reduced, so that product yield can be increased and the manufacturing cost can be reduced.

While the invention has been described with reference to the preferred embodiment above, it should be recognized that the preferred embodiment is given for the purpose of illustration only and is not intended to limit the scope of the present invention and that various modifications and changes, which will be apparent to those skilled in the relevant art, may be made without departing from the spirit and scope of the invention.

What is claimed is:

1. An electrical connector for a circuit board, comprising:
an insulated housing comprising:
a connection plate;
a raised portion; and
two coupling portions extended from two sides of the raised portion and positioned at two opposite sides of the connection plate, wherein the connection plate, the raised portion and two coupling portions together define a recess which is open in a direction perpendicular to and away from the attachment face of the connection plate and is also open in a direction parallel to the attachment face of the connection plate, and wherein each of the coupling portions comprises an upright support protruded upwardly from the connection plate and an engaging recess defined at bottom of the upright support and extended inwardly from a front surface of the upright support;
a pair of narrow metal brackets each corresponding to one of the coupling portions, wherein each of the narrow metal brackets comprises:
a main plate being L-shaped and comprising a bottom plate and a side plate bent from the bottom plate, wherein the bottom plate is disposed on a bottom surface of the corresponding coupling portion, and the side plate is attached to the outer-side surface of the corresponding coupling portion;
a front interference tab comprising an extending section and an inserting section, wherein the extending section is extended from the bottom plate and bent upwardly, and the inserting section is extending from the extending section and bent toward the raised portion to insert into the engaging recess of the corresponding coupling portions;
a rear interference tab extended from the bottom plate and coupled to the corresponding coupling portion; and
at least one positioning tab disposed at an outer side of the main plate and adapted for engagement with the circuit board; and
a plurality of conductive contacts secured in the raised portion along a longitudinal direction.

2. The electrical connector of claim 1, wherein each of the coupling portions further defines a positioning recess for engagement with the rear interference tab.

3. The electrical connector of claim 1, wherein each of the narrow metal brackets is formed by bending a metal sheet.

4. The electrical connector of claim 1, wherein the upright support of each of the coupling portions further comprises an enlarged top end.

5. The electrical connector of claim 1, wherein the raised portion is disposed at one lateral side of the connection plate, a plurality of contact grooves are formed through the raised portion and extended along the longitudinal direction, and each conductive contact is fitted through a corresponding one of the contact grooves along the longitudinal direction, wherein each of the conductive contacts has a fixed section disposed within the corresponding contact groove to secure the conductive contact between the connection plate and the raised portion, a solder section extended backwardly from the fixed section for being soldered onto the circuit board, and a connecting section extended forwardly from the fixed section and protruded beyond the connection plate.

6. The electrical connector of claim 5, wherein the connecting sections are each shaped as a flat plate.

* * * * *